US005340077A

United States Patent [19]

Tyler

[11] Patent Number: 5,340,077

[45] Date of Patent: Aug. 23, 1994

[54] TROLLING MOTOR ANTI-BOUNCE MECHANISM

[75] Inventor: William C. Tyler, Columbus, Miss.

[73] Assignee: Zebco Corporation, Tulsa, Okla.

[21] Appl. No.: 127,166

[22] Filed: Sep. 27, 1993

[51] Int. Cl.[5] ..... F16M 1/00

[52] U.S. Cl. ..... 248/642; 440/63

[58] Field of Search ..... 248/642, 640, 354.1, 248/354.4; 440/55, 63

[56] References Cited

U.S. PATENT DOCUMENTS

| | | | |
|---|---|---|---|
| 1,389,712 | 9/1921 | Thompson | 248/642 X |
| 2,901,267 | 8/1959 | Holsclaw | 248/642 X |
| 3,724,790 | 4/1973 | Harris | 248/642 |
| 3,954,080 | 5/1976 | Weaver | 440/63 X |
| 4,410,161 | 10/1983 | Booty | 440/63 X |
| 4,634,390 | 1/1987 | Baird | 440/55 X |
| 4,685,888 | 8/1987 | Brewer . | |
| 4,828,186 | 5/1989 | Weiss . | |
| 4,842,239 | 6/1989 | Kinsey et al. . | |
| 4,875,656 | 10/1989 | Boede | 248/642 |
| 4,955,834 | 9/1990 | Henderson et al. . | |
| 4,966,566 | 10/1990 | Baird | 440/63 X |

*Primary Examiner*—J. Franklin Foss

*Attorney, Agent, or Firm*—Rosenblatt & Associates

[57] ABSTRACT

The present invention allows fishermen to easily stow the trolling motor and control housing while assuring that damage to the mounting bracket, the trolling motor, and the control housing is minimized. The lower arm of the mounting bracket is secured to the boat. The upper arm of the mounting bracket forms a cantilever that projects from a pivot point. Stress forces will most likely cause metal fatigue to occur on the flange called the "positive stow lock feature" near the pivot point. Shock to the positive stow lock feature is minimized by provision of a rubber-based leg to stabilize the upper arm of the mounting bracket. The suspension of the trolling motor and the control housing limits their downward travel.

The bracket member is mounted within the column support bracket on the upper arm of the mounting bracket and is secured in place by an existing pivot pin. A bore on the top surface of the bracket member engages a bore on the top surface of a tubular member with the aid of a roll pin. The tubular member may be cut to any desired length to accommodate various sizes of motor assemblies. The tubular member in the assembly lies parallel to the column support bracket. A cap covers the distal end of the tubular member and acts to minimize shock to the pivot point area of the bracket.

10 Claims, 2 Drawing Sheets

TROLLING MOTOR ANTI-BOUNCE MECHANISM

FIELD OF THE INVENTION

The field of this invention relates generally to trolling motors, and more particularly to a structure for mounting a trolling motor assembly while in its stowed position.

BACKGROUND OF THE INVENTION

It is known in the industry to provide a mounting bracket for trolling motors that may be stowed against the boat gunwale, with the control housing and propeller motor lying parallel to the gunwale. One of the principal problems in stowing trolling motors in this manner arises when the boat is in transit and bumps, holes, and articles on the road cause damage to the control housing, the mounting bracket, and the motor as they are jarred against the boat gunwale. Similar shock loads occur when the boat is underway using its main motor and the trolling motor is stowed.

In the past, mounting structures have been designed to fold into a recess in the hull and rest on a link supporting the column support bracket, such as U.S. Pat. No. 4,955,834. The control head is cantilevered and puts stresses on linkage pivots when shock loads, during road transport or while motoring in the water with the main motor, cause bouncing of the control head and high stresses in pinned connections of the supporting linkage.

U.S. Pat. No. 3,861,628 demonstrates a mounting bracket assembly that is pivotally adapted to be mounted on the boat deck. The control housing is not supported and cantilevers over the boat hull at the end of a long pivoted link. The trolling motor rests on a rubber pad that is affixed to the deck. When bumps and obstructions are encountered on the road, the overhung control unit stresses the pin connection 70 to its support link 50.

U.S. Pat. Nos. 4,828,186; 4,685,888; and 4,842,239 demonstrate inline shock-absorbing supports which are all used to absorb shocks on outboard motors when in a tilted position away from the transom so that damage may be avoided during trailer transport. The '888 and '186 patents show telescoping rods that are fixed to the transom and the outboard motor via bumpers and straps.

One of the biggest problems in the industry which has not been addressed is the metal fatigue and breakage that occurs at the pivot point on the mounting bracket when the trolling motor is in its stowed position. This metal fatigue occurs because a flange extends over a cavity, called the "positive stow lock feature," and is vulnerable to breakage brought about by stress induced by jarring or from high winds and wave action. Accordingly, one of the objects of the present invention is to ease the stowing of the trolling motor while simultaneously avoiding damage to the mounting bracket, the motor, and the control housing.

SUMMARY OF THE INVENTION

The present invention allows fishermen to easily stow the trolling motor and control housing while assuring that damage to the mounting bracket, the trolling motor, and the control housing is minimized. The lower arm of the mounting bracket is secured to the boat. The upper arm of the mounting bracket forms a cantilever that projects from a pivot point. Stress forces will most likely cause metal fatigue to occur on the flange called the "positive stow lock feature" near the pivot point. Shock to the positive stow lock feature is minimized by provision of a rubber-based leg to stabilize the upper arm of the mounting bracket. The suspension of the trolling motor and the control housing limits their downward travel.

The bracket member is mounted within the column support bracket on the upper arm of the mounting bracket and is secured in place by an existing pivot pin. A bore on the top surface of the bracket member engages a bore on the top surface of a tubular member with the aid of a roll pin. The tubular member may be cut to any desired length to accommodate various sizes of motor assemblies. The tubular member in the assembly lies parallel to the column support bracket. A cap covers the distal end of the tubular member and acts to minimize shock to the pivot point area of the bracket.

DETAILED DESCRIPTION OF THE PREFERRED EMBODIMENT

Figure 1:
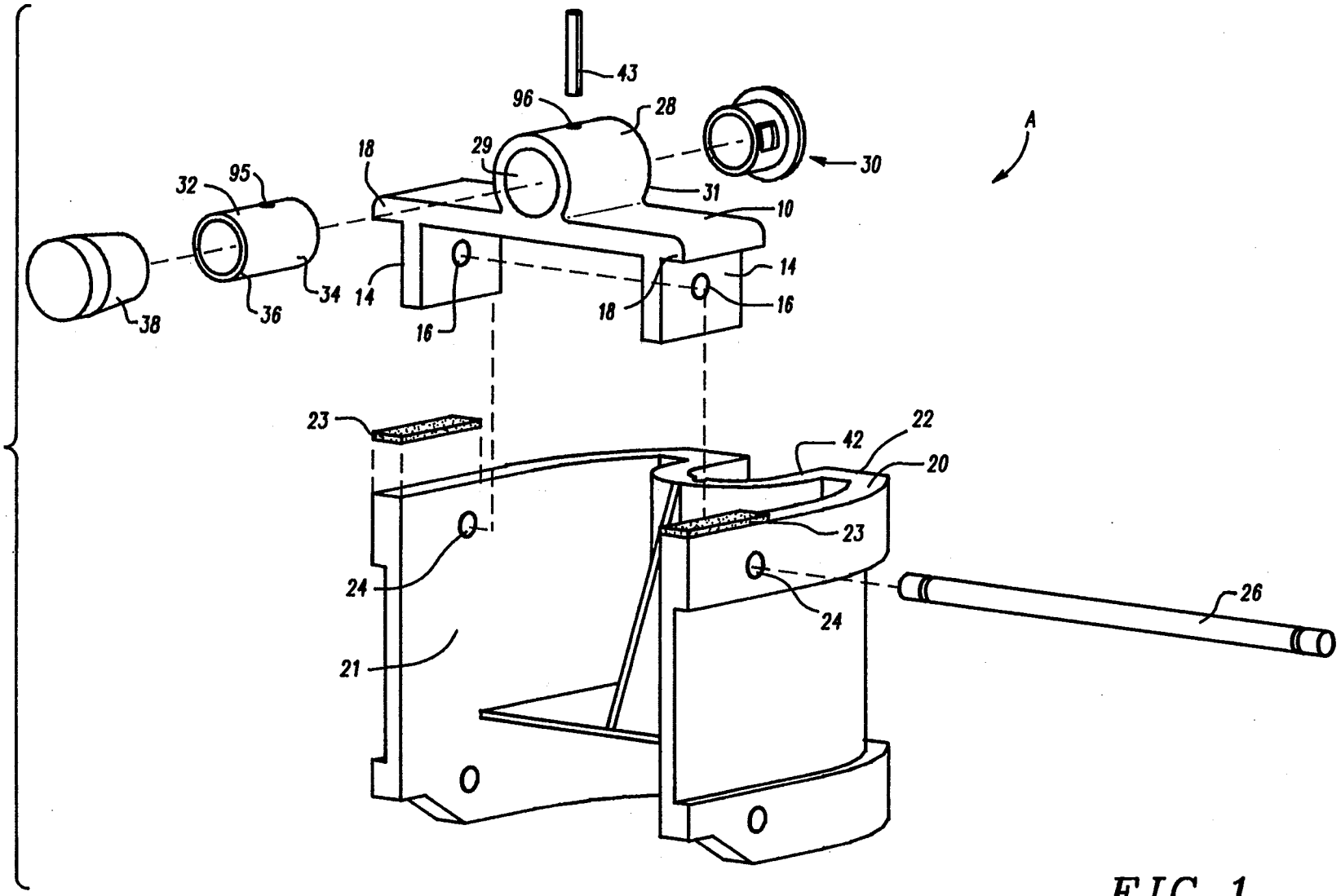
FIG. 1 is an isometric view of the bracket member, the column support bracket, the tubular member, the cap, the end cover, the roll pin, and the neoprene pads.
Figure 2:
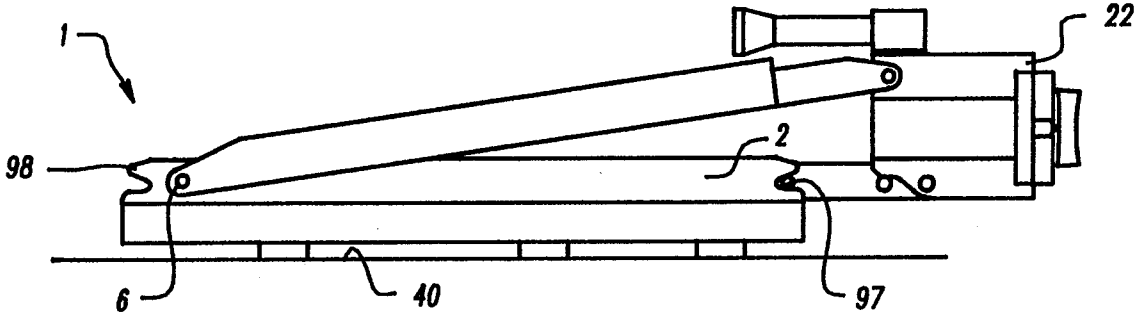
FIG. 2 is a side view of mounting bracket assembly while trolling motor is in normal operating condition.
Figure 3:
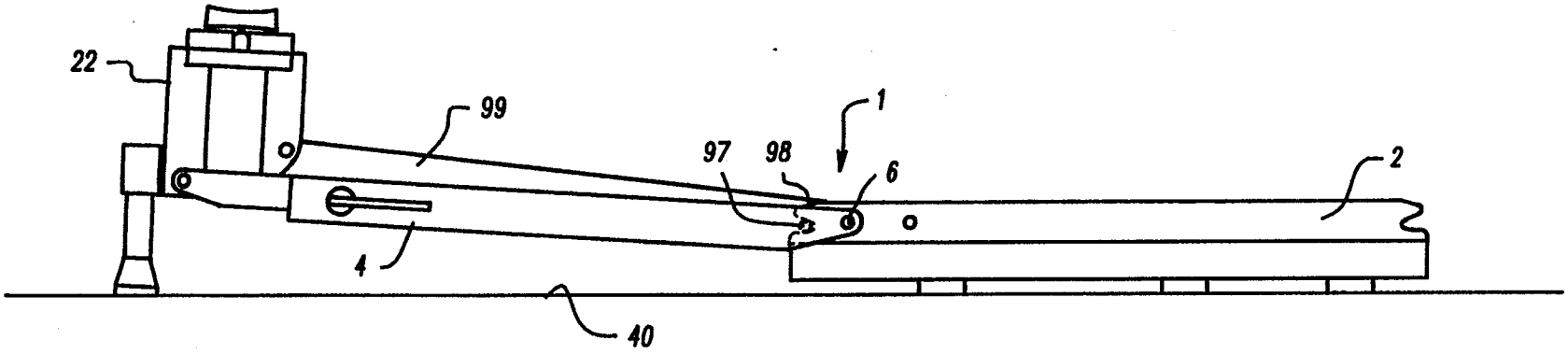
FIG. 3 is a side view of mounting bracket assembly while trolling motor is in its stowed position.

The apparatus A of the present invention is shown in detail in FIG. 1, with its two positions with respect to the gunwale or deck 40 illustrated in FIGS. 2 and 3. In FIG. 2, the column support bracket 22 overhangs the boat deck 40, and the column (not shown) of the trolling motor is firmly supported in channel 42 (see FIG. 1). Accordingly, in the view shown in FIG. 2, the control head of the trolling motor assembly is above the column support bracket 22, with the support shaft extending vertically through column support bracket 22 so that the motor and propeller of the trolling motor assembly are operably in the water. In the position shown in FIG. 3, the control head of the trolling motor assembly is on the far side of the column support bracket 22 from pivot point 6. In the stowed position illustrated in FIG. 3, the upper arm 99 overhangs the lower arm 2 but is ultimately stopped in its motion when surface 44 acts as a further pivoting travel stop to upper arm 99 by contacting lower arm 2. As a result, latch pin 97 in upper arm 99, column support bracket 22, and the control head of the trolling motor (not shown) put significant stresses on flange 98, which is close to pivot point 6. With the boat underway in the water or being hauled on a trailer over the road, the combination of shock loads from such travel and a spaced cantilevered load with respect to flange 98, significant stresses in the prior designs have resulted in stress cracking adjacent pivot point 6 and, if left unrepaired, ultimate failure of lower arm 2.

The apparatus A is shown in FIG. 1. FIG. 2 illustrates the mounting bracket 1 while the trolling motor is in a normal operating position in the water. FIG. 3 illustrates the mounting bracket 1 while the trolling motor is in its stowed position on the boat gunwale. The lower arm 2 of the mounting bracket 1 is secured to the boat. The upper arm 99 of the mounting assembly 1 is pivotally connected at point 6. When stowed, upper arm 99 rests on lower arm 2, with an overhung load of the weight of column support bracket 22 and the trolling motor control head located at the opposed end of upper arm 99 from pivot point 6. As shown in FIG. 3, link 4 is pivotably movable about pivot point 6, which acts as a base for link 4. The first end of link 4 is connected to pivot point 6. The second end of link 4 is connected to support member 32. Support member 32 is pivotably mounted to the trolling motor bracket. In a preferred embodiment, support member 32 is a tubular member. As shown in FIG. 2, when the trolling motor is in its normal operating position in the water, support member 32 is substantially parallel to link 4. As shown in FIG. 3, when the trolling motor is in its stowed position, support member 32 is substantially perpendicular to link 4.

Referring to FIG. 1, the apparatus A is made of the following components: a bracket member 10, a column support bracket 22, neoprene pads 23, an end cover 30, a tubular member 32, a cap 38, and a roll pin 43. The bracket member 10 has a top surface 12 and two side surfaces 14. The side surfaces 14 of the bracket member 10 have two apertures 16. Flanges 18 on the top surface 12 allow the bracket member 10 to rest on the edge 20 of the column support bracket 22. Neoprene pads 23 or some other suitable material are in contact with edge 20 of the column support bracket 22 to prevent noise. The bracket member 10 is inserted into the column support bracket 22 where side surfaces 14 on the bracket member 10 lie in alignment with two apertures 24 on column support bracket 22. These apertures 16 and 24 are aligned to receive the existing pivot pin 26 which secures the bracket member 10 within the column support bracket 22. The top surface 12 of the bracket member 10 has an annular bore 28 having a through hole 96 to engage a through hole 95 on the top surface of the tubular member 32 when properly aligned and connected with roll pin 43. The diameter of the annular bore 28 having through hole 96, and the tubular member 32 diameter and length may vary without departing from the spirit of the invention.

The tubular member 32 has a proximal end 34 and a distal end 36. A roll pin 43 engages aligned through hole 95 on the proximal end 34 and through hole 96 on the annular bore 28 to secure the tubular member 32 within the bracket member 10. An end cover 30 is connected with the proximal end 34 of the tubular member 32 by various means well-known in the art. The distal end 36 is fitted with a rubber or neoprene or similarly suited material cap 38 that is capable of minimizing shock to the pivot point.

The mode of connection of the apparatus can be varied. In the preferred embodiment illustrated, the solution to the problem has involved the attachment of a tubular member, such as a pipe, with a soft or pliable foot 38. Since the linkage involving upper arm 99 is movable for use of the trolling motor, consideration had to be given such that the tubular member 32 would not be in the way for use of the trolling motor assembly in the position shown in FIG. 2 and would at the same time position itself adjustably with respect to the height of the deck 40 when in the stowed position shown in FIG. 3. The preferred structure allows adaptation of an existing column support bracket 22 to accommodate the solution to the stress problem on flange 98. Since the assembly 1 is installed on a wide variety of boats, a flexible solution to the problem is preferred to accommodate the dimensional differences among the various boats. The solution of the preferred embodiment has this adjustability feature through use of tubular members 32 of varying lengths to accommodate the precise installation on a boat in question. The solution is preferable over applications that involve rigid clamping of the upper arm 99 to the deck since variability in installation and changes occurring during use could affect the mechanical performance of a clamping apparatus and itself be a potential source of stress on lower arm 2 and flange 98. Instead, by providing a support near the extreme end of the assembly where most overhung load occurs, the support is placed in its most advantageous position to reduce stresses on lower arm 2 and flange 98 adjacent pivot point 6. Normally, the gunwale or deck 40 is a sufficiently rigid structure to be able to absorb the loads transmitted through tubular member 32 and cap 38. The operator may also make adjustments in the support height of column support bracket 22 to allow for wear and tear of the connecting elements which might otherwise change the supported position of column support bracket 22 with respect to gunwale or deck 40. Tubular member 32 must be positioned and sized prior to pinning into annular bore 28 on top surface 12 of bracket member 10. While a tubular member has been illustrated, different shapes and attachment mechanisms are contemplated to be within the scope of the invention relating to an easily installed support for cantilevered loads on a trolling motor support assembly. For example, tubular member 32 can be adjustably mounted to annular bore 28 such as by threading so that the effective length of member 32 can be changed.

The foregoing disclosure and description of the invention are illustrative and explanatory thereof, and various changes in the size, shape and materials, as well as in the details of the illustrated construction, may be made without departing from the spirit of the invention.

What is claimed is:

1. An apparatus for reducing stress in a boat gunwale or deck-mounted trolling motor support assembly, operable in two positions for use and for stowing trolling motor, comprising:

a base;

at least one movable link, having a first end and a second end, said link connected at its first end to said base, said link movable into a first and second position about a connection point to said base for use of a trolling motor in said first position and stowing a trolling motor in said second position; and a support member extending from adjacent of said link to support said link out of substantial load-carrying contact with said base other than at said connection point.

2. The apparatus of claim 1, wherein:

a trolling motor support bracket is connected to one end of said link;

said connection point is at an opposite end of said link;

said support member extends from said bracket to support said bracket and its trolling motor assembly load off the boat gunwale or deck.

3. The apparatus of claim 2, wherein:

said link has a segment that but for said support member would receive stress from contact with said base in said second position from load thereon, whereupon said support member redefines said second position of said link by contact with the gunwale or deck at least as early as any contact between said segment and said base.

4. The apparatus of claim 3, wherein: said support member is height-adjustable.

5. The apparatus of claim 4, wherein said support member further comprises:

a resilient cap for distribution of loads from said bracket to the boat deck.

6. A trolling motor support assembly for a boat having a gunwale or deck, comprising:

a base mounted to the gunwale or deck;

a link having a first end and a second end, said link operably connected at its first end to said base for movement between a first position for use of a trolling motor and a second position for stowage of a trolling motor on the gunwale or deck;

said link having an engagement surface adjacent said operable connection to said base, defining said second position when said engagement surface is brought into contact with said base; and at least one support mounted adjacent the second end of said link for substantially reducing applied moment to said engagement surface from load on said link.

7. The apparatus of claim 6, wherein said link further comprises:

a trolling motor bracket pivotably mounted adjacent said second end, said support mounted to said bracket, whereupon movement of said link toward said second position orients said support for contact with the gunwale or deck no later than when said engagement surface contacts said base.

8. The apparatus of claim 7, wherein:

said support is height-adjustable.

9. The apparatus of claim 8, wherein said support further comprises:

said a resilient foot adapted for contact with said gunwale or deck to establish said second position of said link.

10. A trolling motor support assembly for a boat having a gunwale or deck, comprising:

(a) a base mounted to the gunwale or deck;

(b) a link having a first end pivotably mounted to said base and a second end opposite said first end, said link being pivotable about said base between a first position for use of a trolling motor and a second position for storage of a trolling motor on the gunwale or deck;

(c) a trolling motor bracket mounted to the second end of said link; and (d) a support member pivotably mounted to said trolling motor bracket such that when the link is in a first position, said support member can be pivoted into a position substantially parallel to said link and when the link is in a second position, said support member can be pivoted into a position substantially perpendicular to said link.

* * * * *